US006561880B1

(12) United States Patent
Hsu et al.

(10) Patent No.: US 6,561,880 B1
(45) Date of Patent: May 13, 2003

(54) APPARATUS AND METHOD FOR CLEANING THE POLISHING PAD OF A LINEAR POLISHER

(75) Inventors: Feng-Chih Hsu, Tainan (TW); Tien-Chen Hu, Ping Tung (TW)

(73) Assignee: Taiwan Semiconductor Manufacturing Co., Ltd., hsin chu (TW)

( * ) Notice: Subject to any disclaimer, the term of this patent is extended or adjusted under 35 U.S.C. 154(b) by 0 days.

(21) Appl. No.: 10/060,824

(22) Filed: Jan. 29, 2002

(51) Int. Cl.[7] ..... B24B 1/00

(52) U.S. Cl. ..... 451/56; 451/59; 451/444; 451/307

(58) Field of Search ..... 451/38, 59, 56, 451/443, 444, 307; 134/94.1; 15/23, 22.3

(56) References Cited

U.S. PATENT DOCUMENTS 5,690,544 A * 11/1997 Sakurai ..... 451/444
6,196,899 B1 * 3/2001 Chopra et al. ..... 451/56
6,312,319 B1 * 11/2001 Donohue et al. ..... 451/56
6,328,637 B1 * 12/2001 Labunsky et al. ..... 451/56
6,341,997 B1 * 1/2002 Lin ..... 451/39

* cited by examiner

*Primary Examiner*—Eileen P. Morgan
(74) *Attorney, Agent, or Firm*—Tung & Associates

(57) ABSTRACT

A linear chemical mechanical polishing apparatus equipped with a brush means and a solvent spray means for cleaning the polishing pad during a chemical mechanical polishing process is described. The brush means may be provided in a cylindrical, tubular shape equipped with bristle for cleaning the surface grooves on the polishing pad and thus, removing large contaminating particles to prevent the particles from scratching the wafer surface. The solvent spray means is used to spray a jet of solvent such as deionized water onto the brush means and the polishing pad for removing debris generated by the polishing process and the cleaning process.

18 Claims, 2 Drawing Sheets

APPARATUS AND METHOD FOR CLEANING THE POLISHING PAD OF A LINEAR POLISHER

FIELD OF THE INVENTION

The present invention generally relates to a linear chemical mechanical polishing apparatus and a method for cleaning the pad and more particularly, relates to a linear chemical mechanical polishing apparatus equipped with a rotatable, cylindrical-shaped brush for cleaning the polishing pad and a method for cleaning the pad.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shallow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A rotary CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer, in a conventional rotary CMP, while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. The layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the rotary CMP process provides a number of advantages over the traditional mechanical abrasion type polishing process, a serious drawback for the CMP process is the difficulty in controlling polishing rates and different locations on a wafer surface. Since the polishing rate applied to a wafer surface is generally proportional to the relative velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated by rotating the wafer surface during the polishing process such that a uniform average polishing rate can be obtained, the wafer surface, in general, is exposed to a variable polishing rate during the CMP process.

More recently, linear chemical mechanical polishing method has been developed in which the polishing pad is not moved in a rotational manner but instead, in a linear manner. It is therefor named as a linear chemical mechanical polishing process in which a polishing pad is moved in a linear manner in relation to a rotating wafer surface. The linear polishing method affords a more uniform polishing rate across a wafer surface throughout a planarization process for uniformly removing a film layer of the surface of a wafer. One added advantage of the linear CMP system is the simpler construction of the apparatus and therefore not only reducing the cost of the apparatus but also reduces the floor space required in a clean room environment.

A typical linear CMP apparatus 10 is shown in FIGS. 1A and 1B. The linear CMP apparatus 10 is utilized for polishing a semiconductor wafer 24, i.e. a silicon wafer for removing a film layer of either an insulating material or a wafer from the wafer surface. For instance, the film layer to be removed may include insulating materials such as silicon oxide, silicon nitride or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18 which rotates at a pre-determined speed. The major difference between the linear polisher 10 and a conventional CMP is that a continuous, or endless belt 12 is utilized instead of a rotating polishing pad. The belt 12 moves in a linear manner in respect to the rotational surface of the wafer 24. The linear belt 12 is mounted in a continuous manner over a pair of rollers 14 which are, in turn, driven by a motor means (not shown) at a pre-determined rotational speed. The rotational motion of the rollers 14 is transformed into a linear motion 26 in respect to the surface of the wafer 24. This is shown in FIG. 1B.

In the linear polisher 10, a polishing pad 30 is adhesively joined to the continuous belt 12 on its outer surface that faces the wafer 24. A polishing assembly 40 is thus formed by the continuous belt 12 and the polishing pad 30 glued thereto. As shown in FIG. 1A, a plurality of polishing pad 30 are utilized which are frequently supplied in rectangular-shaped pieces with a pressure sensitive layer coated on the backside.

The wafer platform 18 and the wafer 24 forms an assembly of a wafer carrier 28. The wafer 24 is normally held in position by a mechanical retainer, commonly known as a retaining ring 16, as shown in FIG. 1B. The major function of the retaining ring 16 is to fix the wafer in position in the wafer carrier 28 during the linear polishing process and thus preventing the wafer from moving horizontally as wafer 24 contacts the polishing pad 30. The wafer carrier 28 is normally operated in a rotational mode such that a more uniform polishing on wafer 24 can be achieved. To further improve the uniformity of linear polishing, a support housing 32 is utilized to provide support to support platen 22 during a polishing process. The support platen 22 provides a supporting platform for the underside of the continuous belt 12 to ensure that the polishing pad 30 makes sufficient contact with the surface of wafer 24 in order to achieve more uniform removal in the surface layer. Typically, the wafer carrier 28 is pressed downwardly against the continuous belt 12 and the polishing pad 30 at a predetermined force such that a suitable polishing rate on the surface of wafer 24 can be obtained. A desirable polishing rate on the wafer surface can therefore by obtained by suitably adjusting forces on the support housing 32, the wafer carrier 28, and the linear speed 26 of the polishing pad 30. A slurry dispenser 20 is further utilized to dispense a slurry solution 34.

The linear CMA process, while presenting certain processing advantages, suffers from a problem of not being able to remove large contaminating particles from the pad surface. The large contaminating particles on the pad surface is formed of polishing byproducts and dried slurry frequently produced in a copper polishing process. Another major contaminating source is tantalum nitride films that are formed during polishing. Tantalum nitride is widely used in copper structures as a polish stop layer. The copper contaminating particles and the tantalum nitride films formed during the polishing process may have sizes that are too big to be accommodated by the surface grooves provided on the polishing pad. As a result, the large contaminating particles or films become a major source for severe scratches on the wafer surface during polishing. While a pad conditioning disk is normally used on the polishing pad during polishing, the conditioning process does not eliminate the generation of such large particles or films. A serious scratch caused by the large contaminating particles or films can cause the scrap of the entire wafer.

It is therefore an object of the present invention to provide a linear chemical mechanical polisher that does not have the drawbacks or the shortcomings of the conventional linear CMA apparatus.

It is another object of the present invention to provide a linear chemical mechanical polishing apparatus that is equipped with a brush means for cleaning the polishing pad and removing large contaminating particles or films.

It is a further object of the present invention to provide a linear chemical mechanical polishing apparatus that is equipped with a brush means and a solvent spray means for cleaning the polishing pad and removing large contaminating particles or films.

It is another further object of the present invention to provide a linear chemical mechanical polishing apparatus that is equipped with a brush means of a rotatable cylinder covered with bristles on its outer cylindrical surface.

It is still another object of the present invention to provide a linear chemical mechanical polishing apparatus that is equipped with a rotatable, cylindrical-shaped brush that rotates in a rotational direction opposite to the rotational direction of the polishing pad.

It is yet another object of the present invention to provide a linear chemical mechanical polishing apparatus that is equipped with a solvent spray means having at least one solvent spray nozzle equipped with a plurality of nozzle openings.

It is still another further object of the present invention to provide a linear chemical mechanical polishing apparatus that is equipped with a rotatable, cylindrical-shaped bush which rotates at a rotational speed in a range of ±50% of the rotational speed of the polishing pad.

It is yet another further object of the present invention to provide a method for linear polishing a substrate that includes the step of engaging a brush means on the surface of the polishing pad and spraying a solvent onto the brush means to remove large particle debris from the pad and the brush means.

SUMMARY OF THE INVENTION

In accordance with the present invention, an apparatus and a method for cleaning the polishing pad of a linear chemical mechanical polishing apparatus are provided.

In a preferred embodiment, a linear polisher for polishing a substrate can be provided which includes an endless loop of a polishing pad that has a first width; a first roller means and a second roller means for mounting the polishing pad and supplying a predetermined tension on the pad; a motor means for rotating the first roller means such that the polishing pad moves at a predetermined linear speed in a longitudinal direction; a substrate holder for mounting the substrate thereto and for pressing an exposed surface of the substrate onto a top surface of the polishing pad; a brush means that is equipped with a bristle which has a second width for pressing against the top surface of the polishing pad; and solvent spray means for removing debris from the brush means.

In the linear polisher for polishing a substrate, the brush means may be a cylinder covered with a bristle on its outer cylindrical surface. The rotatable, cylindrical-shaped brush rotates at a rotational speed in a range of ±50% of the rotational speed of the first roller means. The solvent spray means may be at least one solvent spray nozzle equipped with a plurality of nozzle openings, or two solvent spray nozzles with one directed at the brush means and one directed at the polishing pad. The solvent spray means may be at least one water spray nozzle. The brush means may be a cylindrical-shaped brush, or a rotatable, cylindrical-shaped brush driven by a motor. The second width of the brush means may be in the range of ±50% of the first width of the polishing pad. The rotatable, cylindrical-shaped brush may be driven by a motor in a rotational direction that is the same as the rotational direction of the polishing pad. The substrate holder may be equipped with a pressure means for pressing the substrate onto the polishing pad, or the substrate holder may be equipped with a rotating means for rotating the substrate at a rotational speed of at least 50 rpm.

The present invention is further directed to a method for linear polishing a substrate that can be carried out by the operating steps of providing an endless loop of polishing pad that has grooves in a top surface; providing a brush means that is equipped with a bristle for cleaning the polishing pad; providing a solvent spray means for cleaning the brush means; rotating the endless loop of polishing pad at a predetermined speed; pressing a surface of the substrate to be polished on the top surface of the polishing pad; engaging the bristle on the brush means to the top surface of the polishing pad; and spraying a solvent onto the brush means and removing debris in the bristle removed from the polishing pad.

The method for linear polishing a substrate may further include the step of rotating the brush means in a cylindrical shape at a rotational speed that is in a range of ±50% of the rotational speed of the polishing pad, or the step of rotating the brush means in a cylindrical-shape in a rotational direction that is the same as the rotational direction of the polishing pad. The method may further include the step of providing the solvent spray means in at least two rows of spray nozzles with one row directed at the brush means and the other row directed at the polishing pad.

The method may further include the step of spraying water onto the brush means and the polishing pad simultaneously, or the step of rotating the endless loop of polishing pad by a pair of roller means, or the step of pressing the bristle on the brush means against the top surface of the polishing pad at a predetermined pressure, or the step of spraying water onto the brush means and the polishing pad at a predetermined pressure.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a linear chemical mechanical polishing apparatus that is equipped with a brush means and solvent spray means for cleaning the polishing pad and a method for using the apparatus.

In a preferred embodiment, a brush means is supplied which is equipped with bristle for pressing against the top surface of the polishing pad, and a solvent spray means is used to remove debris from the brush means and the polishing pad. The brush means may be advantageously formed in a cylindrical-shape and covered with bristle on its outer cylindrical surface. The brush means may also be advantageously formed in a rotatable, cylindrical-shape that is driven by a motor. The cylindrical-shaped brush may have a width that is substantially the same as the width of the polishing pad, or a width that is in the range of ±50% of the width of the polishing pad. To achieve maximum efficiency, the rotatable, cylindrical-shaped brush should be driven by a motor in a rotational direction that is opposite to the rotational direction of the polishing pad. The rotatable, cylindrical-shaped brush may be rotated at a rotational speed in a range of ±50% of the rotational speed of the polishing pad.

In the present invention linear chemical mechanical polishing apparatus, the solvent spray means may be constructed of at least one solvent spray nozzle that is equipped with a plurality of nozzle openings. The solvent spray means may be preferably constructed of two solvent spray nozzles, each equipped with a plurality of nozzle openings, wherein one spray nozzle is directed at the brush means, while the other is directed at the polishing pad. The solvent spray means may be used to spray a solvent such as deionized water for cleaning the brush and the polishing pad.

The invention further discloses a method for cleaning a polishing pad of a linear chemical mechanical polishing apparatus. In the method, a brush means that is equipped with bristle for cleaning the pad and a solvent spray means for cleaning the brush means are first provided. The bristle on the brush means is then engaged with the top surface of the polishing pad, while a solvent is sprayed onto the brush means for removing debris in the bristle that has been removed from the polishing pad.

Figure 1A:
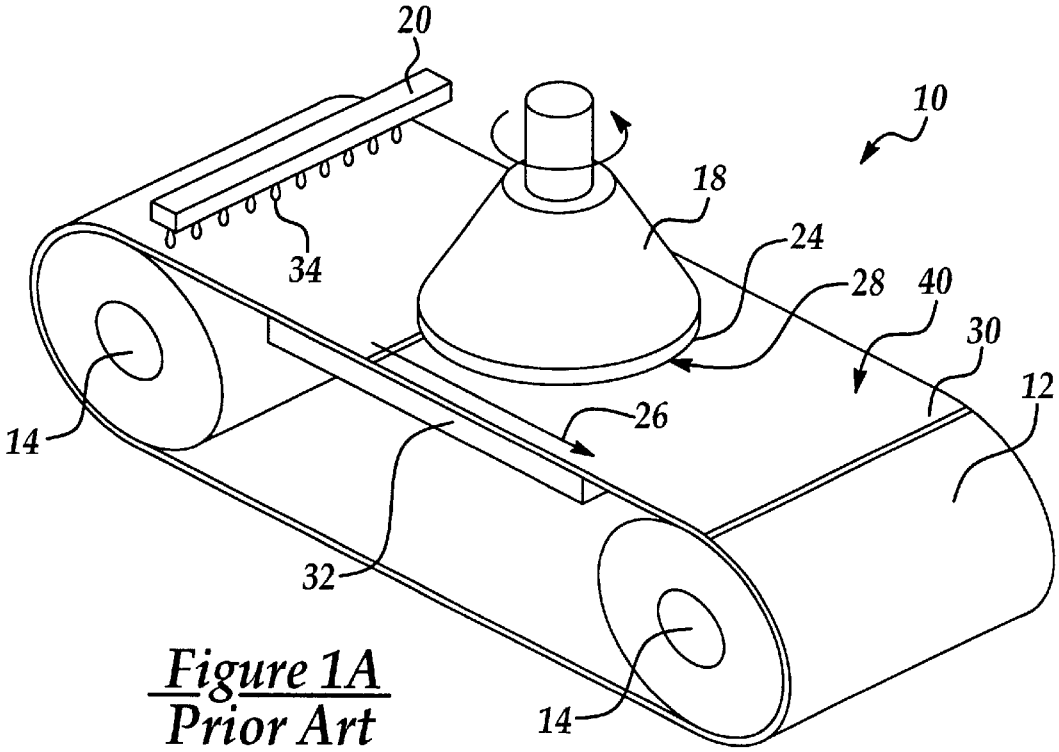
Figure 1A Prior Art
FIG. 1A is a perspective view of a conventional linear chemical mechanical polishing apparatus.
Figure 1B:
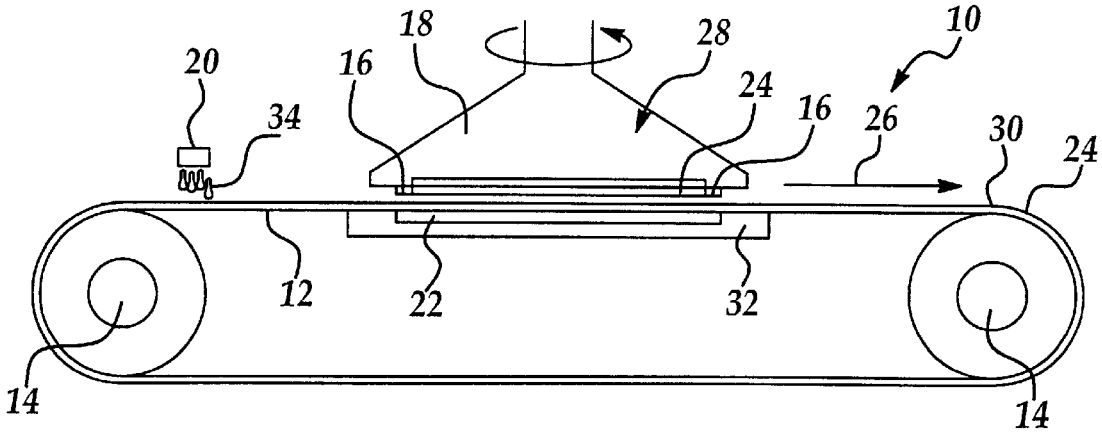
Figure 1B Prior Art
FIG. 1B is a cross-sectional view of the conventional linear chemical mechanical polishing apparatus of FIG. 1A.
Figure 2A:
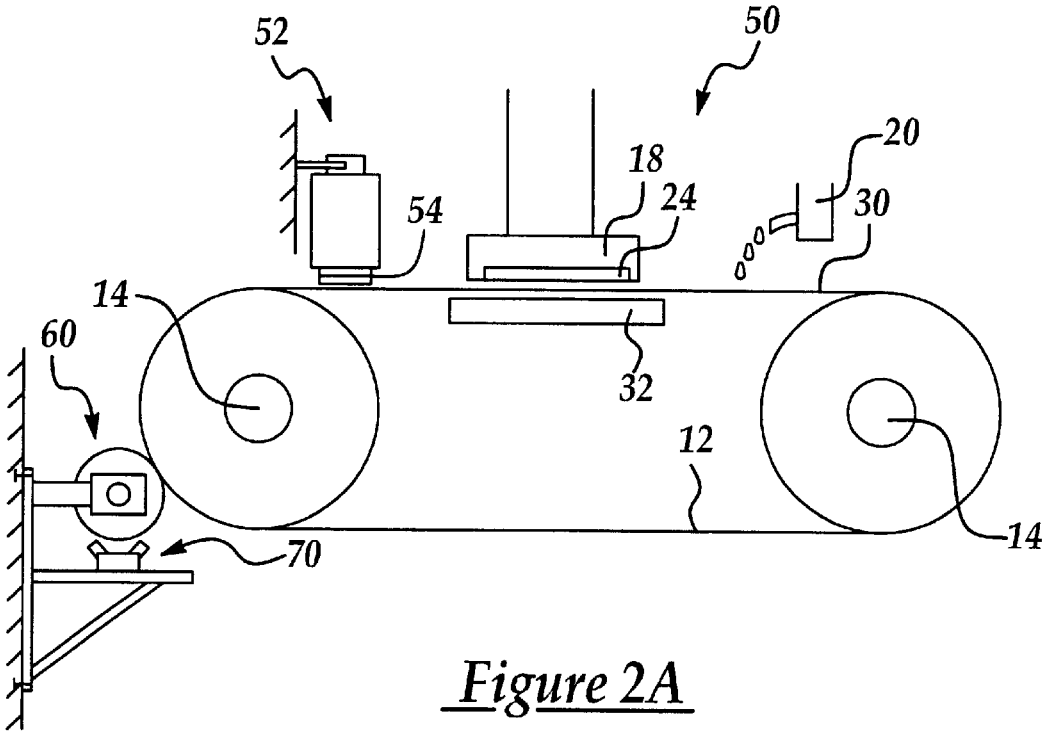
FIG. 2A is a cross-sectional view of the present invention linear chemical mechanical polishing apparatus equipped with the brush cleaning means.

Referring now to FIG. 2A, wherein a present invention linear chemical mechanical polishing apparatus 50 is shown. The linear CMP apparatus 50 is constructed similarly by those elements shown in FIG. 1A, for instance, by a linear continuous belt 12 stretched over a pair of rollers 14, a polishing pad 30 which is adhesively joined to the continuous belt 12 on its outer surface that faces the wafer 24. A plurality of polishing pads 30 are utilized which are supplied in rectangular shape with a pressure sensitive layer coated on the backside.

A polishing pad conditioning device 52 is used on the polishing pad 30 during the polishing process. The pad conditioning device 52 includes a conditioning disk 54 that is in direct contact with the surface of the polishing pad 30.

Figure 2B:
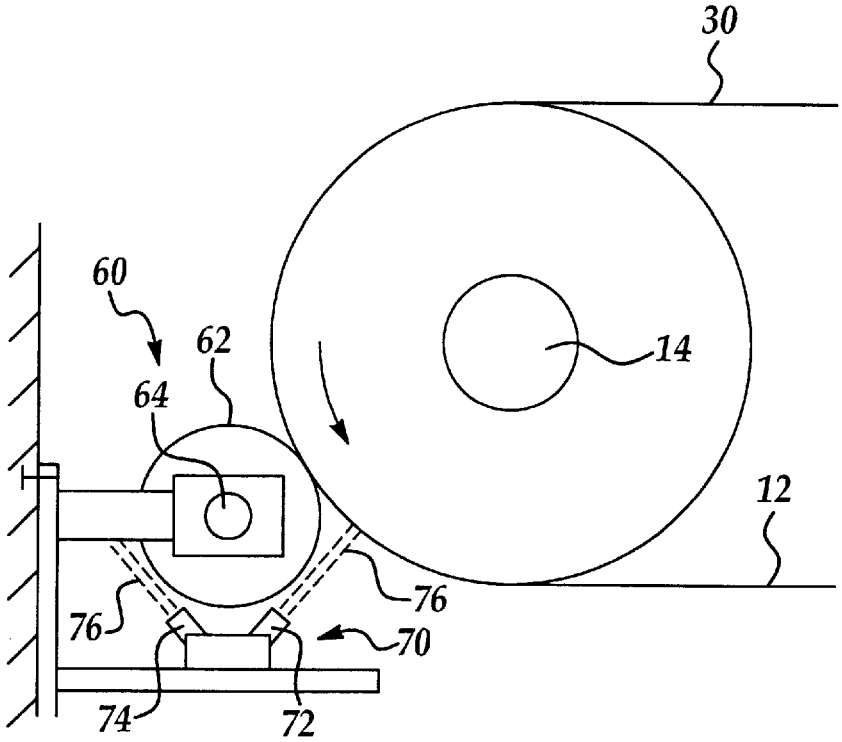
FIG. 2B is a partial, enlarged cross-sectional view of the present invention brush means and solvent spray means engaging a polishing pad of the linear CMA apparatus.

The present invention linear chemical mechanical polishing apparatus 50 is equipped with the brush means 60 and the solvent spray means 70, as shown in FIG. 2A. An enlarged view of the brush means 60 and the solvent spray means 70 is shown in FIG. 2B. The brush means 60 is preferably formed in a cylindrical-shape provided with bristle (not shown) on the outer surface of the cylindrical tube 62. The cylindrical tube 62 is driven by a motor 64 in a direction that is the same as the rotational direction of the polishing pad 30. For instance, as shown in FIG. 2B, when the polishing pad 30 is rotated in a counter-clockwise direction, the cylindrical tube 62 of the brush means 60 is rotated also in a counter-clockwise direction. The rotational speed of the cylindrical tube 62 should be about the same as the rotational speed of the polishing pad 30, or within ±50% of the rotational speed of the polishing pad 30. Even though not shown in FIG. 2B, the cylindrical tube 62 should be equipped with a tension device for pressing against the polishing pad 30 during the brush cleaning process such that the surface grooves on the polishing pad 30 can be efficiently cleaned by the bristle on the cylindrical tube 62. The width of the cylindrical tube 62 should be about the same as the width of the polishing pad 30 such that the entire surface area of the polishing pad can be cleaned when contacted by the cylindrical tube 62.

The solvent spray means 70 should be equipped with at least one solvent spray nozzle, and preferably, with two solvent spay nozzles 72 and 74. Each of the solvent spray nozzles 72,74 may consist of a plurality of nozzle openings arranged in a row which is not shown in FIG. 2B. A spray of solvent 76 is directed at the bristle on the cylindrical tube 62, or at the polishing pad 30, as shown in FIG. 2B. The bristle on the cylindrical tube 62 can thus be thoroughly cleaned by suitably adjusting the solvent spray pressure. Similarly, the surface grooves (not shown) on the polishing pad 30 may also be sufficiently cleaned by the pressurized solvent spray 76. A suitable solvent for use in a semiconductor fabrication facility is deionized water, even though other solvent may also be used.

The present invention novel apparatus and method for cleaning a polishing pad on a linear chemical mechanical polishing apparatus have therefore been amply described in the above description and in the appended drawings of FIGS. 2A and 2B.

While the present invention has been described in an illustrative manner, it should be understood that the terminology is intended to be in a nature of words of description rather of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A linear polisher for polishing a substrate comprising:

an endless loop of a polishing pad having a first width;

a first roller means and a second roller means for mounting said polishing pad and supplying a predetermined tension on said pad;

a motor means for rotating said first roller means such that said polishing pad moves at a predetermined linear speed in a longitudinal direction;

a substrate holder for mounting said substrate thereto and for pressing an exposed surface of said substrate onto a top surface of said polishing pad;

a brush means equipped with a bristle having a second width for pressing against said top surface of the polishing pad, said brush means being a rotatable, cylindrical-shaped brush driven by a motor, said second width of the brush means being in the range of within ±50% of said first width of said polishing pad; and solvent spray means for removing debris from said brush means.

2. A linear polisher for polishing a substrate according to claim 1, wherein said brush means being a cylinder covered with bristle on its outer cylindrical surface.

3. A linear polisher for polishing a substrate according to claim 1, wherein said brush means being a cylindrical-shaped brush.

4. A linear polisher for polishing a substrate according to claim 1, wherein said rotatable, cylindrical-shaped brush is driven by a motor in a rotational direction the same as the rotational direction of said polishing pad.

5. A linear polisher for polishing a substrate according to claim 1, wherein said rotatable, cylindrical-shaped brush rotates at a rotational speed in a range of ±50% of the rotational speed of said first roller means.

6. A linear polisher for polishing a substrate according to claim 1, wherein said solvent spray is at least one solvent spray nozzle equipped with a plurality of nozzle openings.

7. A linear polisher for polishing a substrate according to claim 1, wherein said solvent spray means is two solvent spray nozzles with one directed at said brush means and one directed at said polishing pad.

8. A linear polisher for polishing a substrate according to claim 1, wherein said solvent spray means is at least one water spray nozzle.

9. A linear polisher for polishing a substrate according to claim 1, wherein said substrate holder being equipped with a pressure means for pressing said substrate onto said polishing pad.

10. A linear polisher for polishing a substrate according to claim 1, wherein said substrate holder being equipped with a rotating means for rotating said substrate at a rotational speed of at least 50 RPM.

11. A method for linear polishing a substrate comprising the steps of:

providing an endless loop of polishing pad having grooves in a top surface;

providing a brush means equipped with bristle for cleaning said polishing pad, said brush means being a rotatable, cylindrical-shaped brush driven by a motor, said second width of the brush means being in the range of within ±50% of said first width of said polishing pad;

providing a solvent spray means for cleaning said brush means;

rotating said endless loop of polishing pad at a predetermined speed;

pressing a surface of said substrate to be polished on said top surface of the polishing pad;

engaging said bristle on said brush means to said top surface of the polishing pad; and spraying a solvent onto said brush means and removing debris in said bristle removed from said polishing pad.

12. A method for linear polishing a substrate according to claim 11 further comprising the step of rotating said brush means in a cylindrical shape at a rotational speed that is in a range of within ±50% of the rotational speed of said polishing pad.

13. A method for linear polishing a substrate according to claim 11 further comprising the step of rotating said brush means in a cylindrical shape in a rotational direction that is the same as the rotational direction of said polishing pad.

14. A method for linear polishing a substrate according to claim 11 further comprising the step of providing said solvent spray means in at least two rows of spray nozzles with one row directed at said brush means and the other row directed at said polishing pad.

15. A method for linear polishing a substrate according to claim 11 further comprising the step of spraying water onto said brush means and said polishing pad simultaneously.

16. A method for linear polishing a substrate according to claim 11 further comprising the step of rotating said endless loop of polishing pad by a pair of roller means.

17. A method for linear polishing a substrate according to claim 11 further comprising the step of pressing said bristle on said brush means against said top surface of the polishing pad at a predetermined pressure.

18. A method for linear polishing a substrate according to claim 11 further comprising the step of spraying water onto said brush means and said polishing pad at a predetermined pressure.

* * * * *